US005215071A

United States Patent [19]

Mertes et al.

[11] Patent Number: 5,215,071

[45] Date of Patent: Jun. 1, 1993

[54] RIDING PAVEMENT SAW

[75] Inventors: Anthony J. Mertes, Chanhassen; Leonard L. Shope, Eden Prairie, both of Minn.

[73] Assignee: Cimline, Inc., Eden Prairie, Minn.

[21] Appl. No.: 642,823

[22] Filed: Jan. 18, 1991

[51] Int. Cl.[5] ..... B28D 1/04

[52] U.S. Cl. ..... 125/13.01; 125/13.03; 299/39

[58] Field of Search ..... 125/13.01, 13.03; 299/1, 36, 39, 81

[56] References Cited

U.S. PATENT DOCUMENTS

| | | | |
|---|---|---|---|
| 2,468,336 | 4/1949 | Lewis . | |
| 2,736,544 | 2/1956 | Wright . | |
| 2,857,147 | 10/1958 | Lewis . | |
| 3,663,060 | 5/1972 | Shatwell et al. . | |
| 3,779,608 | 12/1973 | Hatcher et al. . | |
| 3,779,609 | 12/1973 | James . | |
| 3,929,377 | 12/1975 | Weaver et al. . | |
| 4,175,788 | 11/1979 | Jacobson et al. . | |
| 4,204,714 | 5/1980 | Jacobson et al. . | |
| 4,463,989 | 8/1984 | Kennedy . | |
| 4,516,808 | 5/1985 | Staab et al. | 299/39 |
| 4,637,753 | 1/1987 | Swisher, Jr. . | |
| 4,662,684 | 5/1987 | Marten . | |
| 4,676,557 | 6/1987 | Shope et al. . | |
| 4,778,304 | 10/1988 | Baldi et al. . | |
| 5,046,890 | 9/1991 | Dickson | 299/39 |

OTHER PUBLICATIONS

Exhibit A *RPS-3890/RC Rideable Pavement Saw for Random Crack Sawing*, Copyright 1989, Magnum Diamond & Machinery, Inc.

*Primary Examiner*—M. Rachuba

*Attorney, Agent, or Firm*—Merchant, Gould, Smith, Edell, Welter & Schmidt

[57] ABSTRACT

A riding saw apparatus (20) has hydrostatic and hydraulic controls (26, 30, 31, 32) which are movable to various positions for different sawing operations. In addition, saw blades (72) mounted on a cutting assembly (24, 25) are movable to different positions at different angles for performing a number of sawing operations including sawing joints, making angled cuts, and following random cracks or curves. In addition, a timing mechanism (82) may be added so that the saw (20) may utilized for sawing recesses (110) in the pavement. The timing - mechanism (82) uses a cam (84) with a cam follower (86) controlling the depth of the cut of the blades (72). The saw also utilizes a mounting bracket (80) for mounting front wheels (38) or the cutting assemblies (24, 25) in different positions for the various sawing operations.

20 Claims, 4 Drawing Sheets

FIG. 7
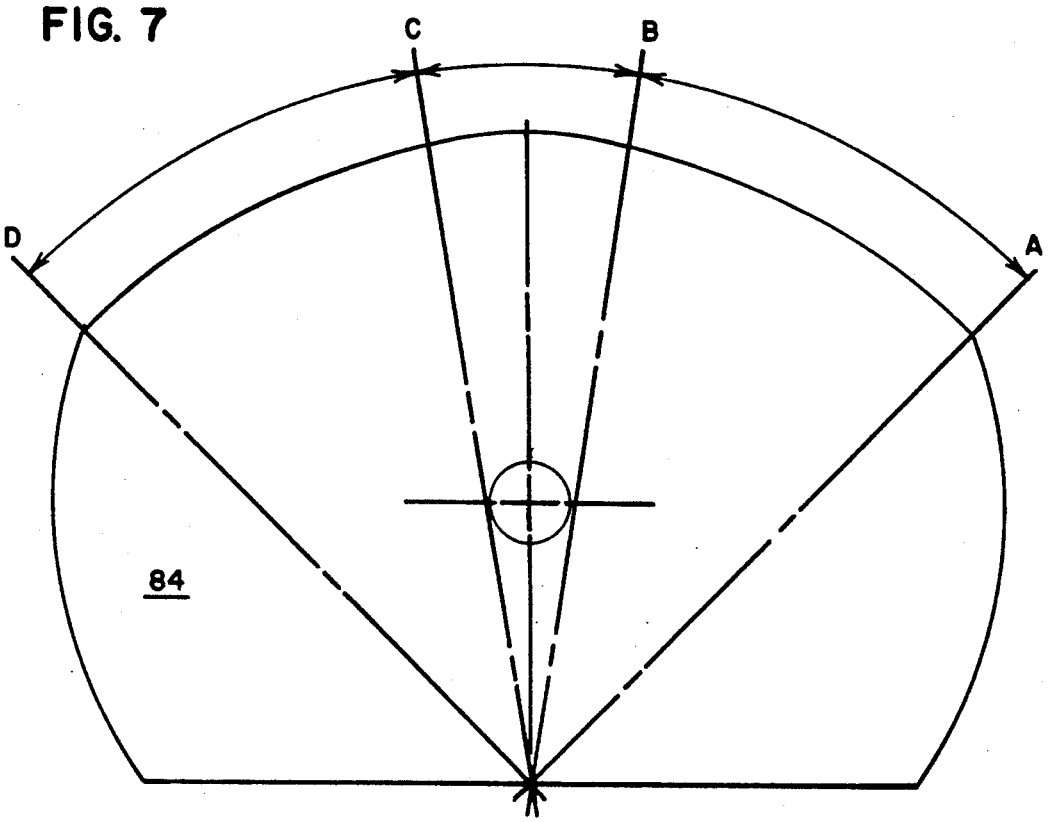
FIG. 8
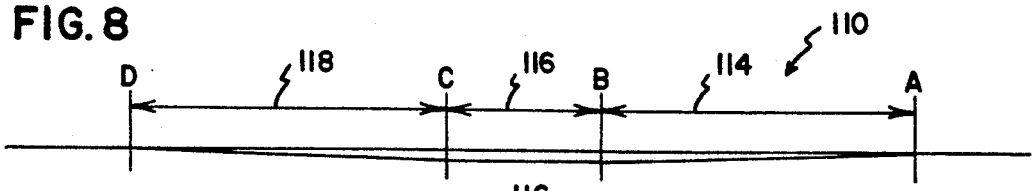
FIG. 9
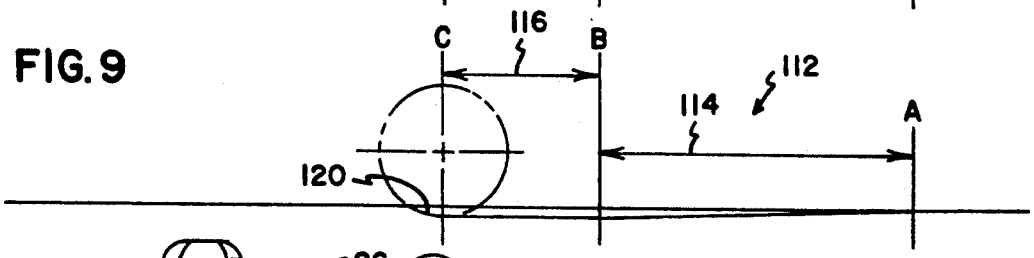
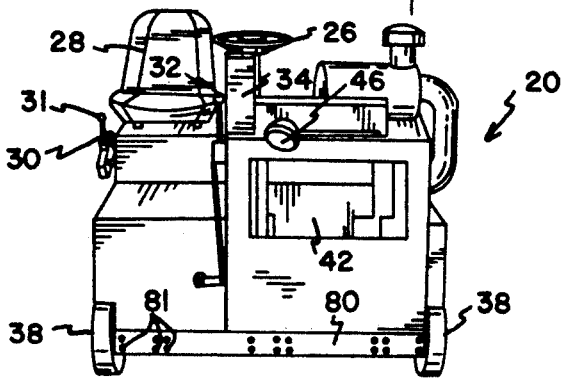
FIG. 3

RIDING PAVEMENT SAW

BACKGROUND OF THE INVENTION

1. Field of the Invention

The present invention is related to a riding pavement saw which is capable of performing a variety of pavement sawing tasks with a single machine.

2. Description of the Prior Art

Devices for sawing pavement are well known and riding pavement saws are now being introduced. Pavement sawing is done to establish expansion joints, to improve roads and to increase the life of roadways. Pavement develop cracks for a number of reasons including freeze thaw cycles, shifting subgrades and excessive loads as with trucking. Once cracks develop, water and dirt fill the space and the rate of deterioration for the pavement increases rapidly. To prevent further cracking, the crack is sawed out to form a smooth channel and is then cleaned, dried and filled with joint sealant materials which expand and contract with the roadway without the materials breaking their bond so that foreign materials such as water are not allowed to leak through and weaken the subgrade.

Joints which are filled are of two general types, straight line cuts and random cracks. Straight line cuts are generally found on concrete slabs on roadways and for creating rumble strips. The type of blade used for sawing straight lines varies with the type of pavement being sawed, but generally 14" and larger diameter blades are used in straight line sawing applications.

A second type of straight line sawing is performed for patching. In patching, a section of pavement is sawed around its circumference and then removed. To ease removal, the outline is sawed at an angle rather than vertically, so that the section of pavement can be slid out without the sides of the section and surrounding pavement interfering, easing removal. This sawing has the blades typically angled at 2°-3° from vertical.

Random cracks require sharp turns to follow the cracks which wind in an arbitrary, irregular pattern. Smaller diameter blades, typically 8 to 10 inches, are used for random crack sawing so there is less blade in the pavement which improves maneuverability and reduces drag or friction. The saw operator must have a clear unobstructed view of the crack in order to steer the saw so that the crack is followed closely to ensure a smooth channel surface for filling and sealing. Heretofore, random cracks and cracks on curves have been sawed with manual saws wherein the operator pushes or pulls and steers the saw from the rear. Manual steering and propulsion of a push type saw is physically demanding on the operator, making operation a difficult and tiring job. A self-propelled riding saw greatly reduces the physical requirements needed for sawing cracks, especially when the saw must be turned. The driver in a riding saw needs to have the blade in full view preferably almost straight down. In addition, the blades should be between the front wheels for support, as shown in U.S. Pat. No. 3,663,060, with the blades as close to the center of turning as possible so that the blades do not face sideways resistance when turning. If the blades are not substantially centered on the turning radius, the blades clear too wide of a path through turns as the blades are dragged through the turns.

In addition to sawing random cracks and straight line sawing, other sawing operations are performed including sawing recesses for placing reflectors in highways at spaced intervals. The depressions which are sawed usually have a special cross section which requires accurate timing for raising and lowering of the blades to form the correct shape. Some reflectors require sloping entering the depression and exiting the depression while other depressions require a slope entering the depression but a relatively steep exit slope. To achieve the proper entrance and exit slopes for reflector depressions, the timing of lifting and lowering the saw blades is critical.

Heretofore, riding saws were not capable of performing multiple sawing tasks such as sawing straight line joints, sawing random or curve cracks, and sawing depressions for reflectors. Different jobs requires different blades and a different steering or seating position. It has not been possible to alter the steering and drive mechanisms on a single riding saw to accommodate the various saw blades and steering positions required to perform more than one sawing operation. Prior Art riding saws use a belt drive system for driving the saw blades. Moving the cutting head to multiple positions or multiple angles is very difficult since the engine itself must be relocated or angled for proper belt alignment. Drive belts make adjustments for different applications cumbersome and time consuming.

It can be seen then, that the requirements for sawing straight line joints, random cracks and special sawing operations are difficult to meet with a single sawing machine. The present inventions provides a single machine capable of performing a number of different sawing operations.

SUMMARY OF THE INVENTION

The present invention is directed to a riding pavement saw which is capable of performing a number of pavement cutting operations. The present invention is hydraulically controlled and drives the operating components with hydraulics for improved flexibility so that elements may be rearranged for performing various operations. Being hydraulically driven, operating mechanisms can be easily moved for performing different sawing operations by simply remounting and rearranging the hydraulic components and their respective hydraulic lines to the driven component, rather than rearranging the engine and remounting belts and pulleys. The riding saw has different cutting assemblies which are mounted at the front of the saw on a bracket having a number of attachment positions. The cutting assembly can be attached at any of these positions for performing different sawing jobs.

For straight line sawing, the cutting assembly is attached so that the blade extends to the right of the saw. In this manner, the operator is seated near the right side of the saw at a rear position with the controls all positioned within easy reach of the operator. In addition, the saw may have the blade assembly tilted for making angled cuts, such as is used for repairing patches of pavement.

For cutting random cracks, the cutting assembly is moved to the left side of the mounting bracket so that the saw blades are positioned substantially at the center of the saw. The front wheels are mounted on wheel brackets which are also bolted to the mounting bracket so the wheels are exactly in line with the blade centerline.

The saw has a rear center wheel for steering so that when turning, the saw blades are positioned between the front wheels at the approximate center of the turning radius of the saw. This provides for following cracks or curves without dragging or pulling the saw blade sideways through the turns, resulting in more accurate cutting and less wear on the blades. To improve operation and follow the cracks more closely, the operator is moved to the front of the saw and the various controls are moved as well. The saw speed control, blade speed control, height adjustment control of the saw blades, and steering wheel all can be easily moved and remounted with only having to move the components and/or hydraulic lines leading from the controls. No engine, belt or pulley remounting is required.

The saw is adaptable for performing specialty cuts which require precise coordinated control for depth of the blades and sawing speed. To facilitate this control, the saw uses a control circuit or similar electronics, such as a microprocessor, depending on the sawing application, receiving signals from various sensors to ensure proper cutting. A timing mechanism on the cutting assembly raises and lowers the saw blade in a controlled manner. For cutting recesses for reflectors, the cutting assembly utilizes a cam with a cam follower. The cam has a radius which changes so that as the cam rotates, the cam follower rises and falls with the changing radius of the cam. The cam follower controls the height of the blade assembly so that as the cam rotates, the cam follower rises and falls and the blades rise and fall with the follower. To change the depth or length of the cut, the control circuit may be changed and/or a new cam may be added.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference numerals and letters indicate corresponding elements throughout the several views:

FIG. 3 shows a front perspective view of the riding saw shown in FIG. 1 without a blade assembly;

FIG. 7 shows a detail view of a timing cam used in the timing assembly shown in FIG. 5;

FIG. 8 shows a side elevational view of a depression cut in the pavement, for receiving a recessed reflector; and, FIG. 9 shows a side elevational view of a second type of depression cut in the pavement for receiving a recessed reflector; and, FIG. 10 shows a front elevational view of the pavement saw shown in FIG. 1 configured for patchwork sawing with an angled blade assembly.

DETAILED DESCRIPTION OF THE PREFERRED EMBODIMENTS

Figure 1:
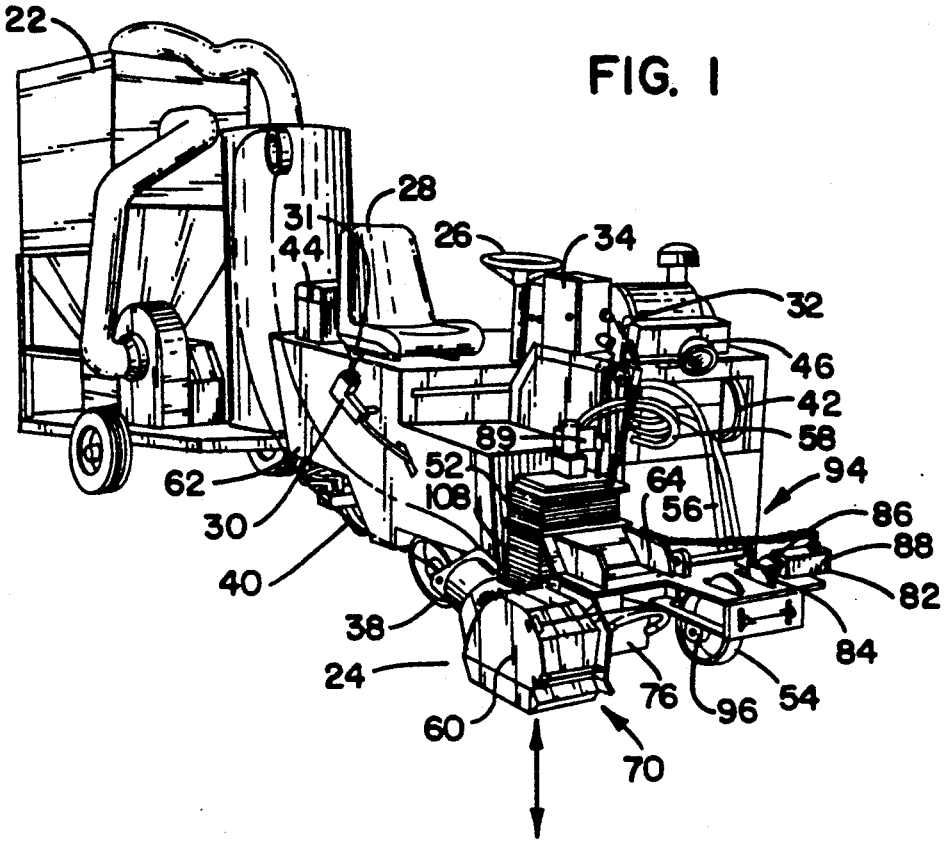
FIG. 1 shows a perspective view of a riding pavement saw pulling a vacuum trailer according to the principles of the present invention with the blade assembly mounted for sawing straight line joints, rumble strips or recesses for markers.

Referring now to the Figures, and in particular to FIG. 1, there is shown a riding pavement saw 20. The saw 20 pulls a vacuum trailer 22 which is used to suction dust and debris created from dry sawing applications and which includes a cyclone separator to separate dust and debris from the airflow. A cutting assembly 24 attaches to a mounting plate (not shown in FIG. 1) on the front of the riding saw 20 and is configured for straight line sawing in FIG. 1. The saw 20 rides on a pair of front wheels 38 at either side of the saw body for a wider base providing increased stability. The saw 20 is driven and steered by a single rear wheel 40, having 180° rotation enabling very precise maneuvering. The saw operator sits on seat 28 positioned at the right side of the saw 20, but which may be moved to a different position for various types of sawing, as explained hereinafter.

The operator controls the saw 20 with steering wheel 26, travel speed and direction control lever 30, blade height control switch 31, and saw blade speed and direction control lever 32. The items 26, 30, 31 and 32 control hydraulic components via flexible hoses, electric wires or control cable so that relocating them is easily done by moving the respective component and hose wire or cable rather than rearranging and remounting large components, belts and pulleys as is required with conventional controls.

The riding saw 20 is also equipped with a tool box 44 and a work light 46 mounted at the front of the saw to illuminate the work area. Blade lifting and lowering and saw speed for special sawing operations is controlled with electronic controls 34 which may be control circuits or a microprocessor, depending on the control requirements for the saw 20. Power for sawing and propulsion as well as other operations is supplied by engine 42. Power is transmitted from pumps on engine 42 through hydraulic lines to the various operations, rather than with belts or gears. Hydraulic control provides for movement of controls and machine components without having to relocate the engine 42, realign belts, gears, cams or chains as would otherwise be required. The flexibility of the controls and the sawing operation devices provides for performing multiple sawing operations, such as straight line joint sawing, random crack or curve sawing, rumble strips, angle sawing, or sawing depressions for recessed reflectors, with a single riding saw by rearranging elements on the saw.

When the riding saw 20 is performing straight line joint sawing, it generally is configured as shown in FIG. 1. The cutting assembly 24 is attached to mounting bracket (not shown in FIG. 1) at the far right side of the saw 20. In this position the saw blades (not shown in FIG. 1) and shroud 60 are positioned to the right of the saw 20 so that the operator seated at the right side of the saw has a clear view for aligning the joint and the blades.

The blade assembly 70 of cutting assembly 24 raises and lowers from a non-cutting position to a sawing position, shown in FIG. 1, which may be varied for changing cutting depth. The blade assembly 70 rides up and down on lift mechanism 52. The lift mechanism 52 taps power from the engine 42 along hydraulic hoses 58 and is hydraulically driven. A screw feed 108 having an accordion-type cover provides infinite height adjustment between the fully lowered and fully raised positions. The power to the cutting motor 76 of the cutting assembly 24 is provided along hydraulic hoses 56 from the pumps attached to engine 42. This permits angling or relocating the assembly 70 without moving the engine, readjusting belts or using complex linkages to provide power transmission. The rotational direction and speed of the blades 72 are controlled by moving the hydrostatic control lever 32. In addition, if vacuuming of debris is required, suction is provided by the vacuum trailer 22 along a vacuum line 62 which is flexible and does not require adjustment or detachment when raising or lowering the blade assembly 70. The blade assembly 70 also may have a timing mechanism 82 attached for cutting depressions in the pavement for recessed reflectors, as explained hereinafter.

As shown in FIG. 3, the mounting bracket 80 attaches along the bottom of the front of the saw 20. The mounting bracket 80 has attachment holes 81 spaced along the bracket 80. The holes 81 provide for bolting the cutting assembly 24 and front wheels 38 to the saw 20 in a number of positions so that the blades can be configured for various sawing operations. The cutting assembly 24 may be mounted so the blades are positioned to the right of the saw 20, at the midpoint between the front wheels 38 and may also be attached so that the blades are angled.

Figure 2:
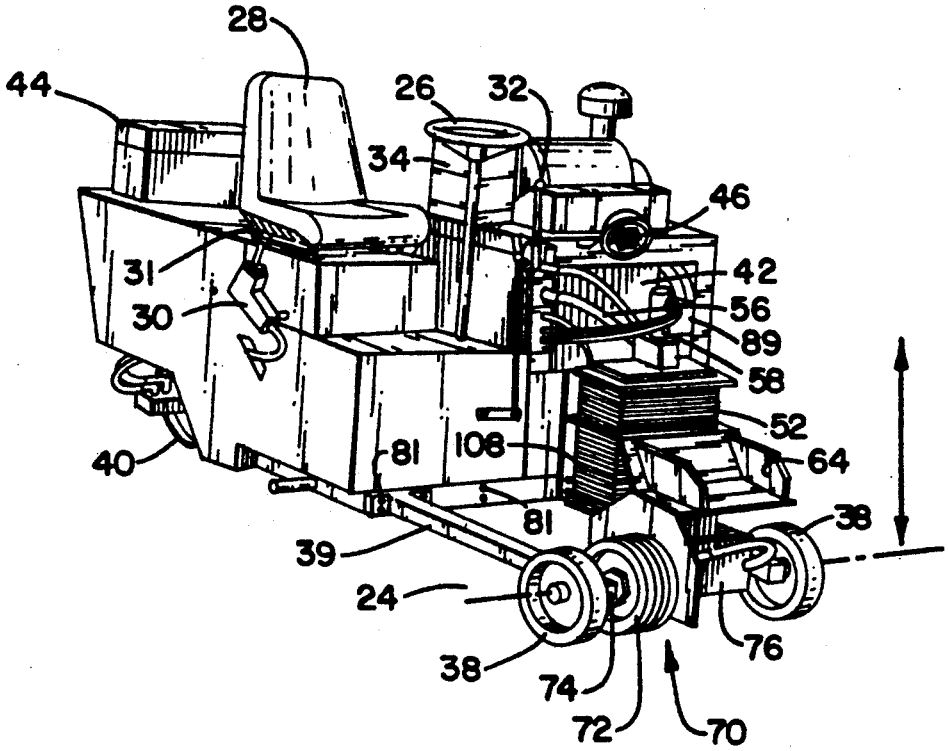
FIG. 2 shows a perspective view of the riding saw shown in FIG. 1 configured for curve or random crack sawing.

As shown in FIG. 2, the saw 20 is configured for random crack or curve sawing. For random crack or curve sawing, saw blades 72 must be proximate the center of the turning radius of the saw 20 so that the blades follow the desired path rather than being dragged around a curve. With the blades 72 centered on the curve to be followed, the bottom of the blades 72 are above the center of the turning radius of the saw 20, so that side motion of the blades 72 is minimized and steering is improved. So that the blades 72 are positioned closest to the center of the turning radius, the blade assembly 70 is moved to the far left of the mounting plate 80. In this position, arbor 74, extending to the right from the hydraulic motor 76 of the blade assembly 70, is at the center of the mounting plate 80 at the front of the saw 20. In addition, the front wheels 38 are mounted on members 39 attaching to the mounting bracket 80, providing added support at both sides of the blades 72. The blades 72 are mounted along the line extending between the front wheels 38, and are centered between the wheels 38 so that with steering from rear wheel 40, the blades 72 are placed substantially at the center of the turning radius of the saw 20. Since the blades 72 and the lift mechanism 52 are both hydraulically driven, only the mounting bolts, the hydraulic lines 56 and 58 and front wheels 38 need be rearranged. The hydraulic lines 56 and 58 need not be disconnected and are moved with the blade assembly 70. The engine does not need to be rearranged and no belts or gears must be moved and realigned or rearranged as required with belt driven saws.

In addition to the cutting assembly 24 being movable to optimize operation, the operator should be seated so that he/she has a clear view of the crack or curve being followed and the blades 72. Therefore, the seat 28 is moved forward and mounted nearer the front of the saw 20 in the position shown in FIG. 2 for random crack and curve sawing. The hydraulic steering wheel 26, hydrostatic saw speed and direction control 30, blade height control 31, and blade speed and direction control 32 are also moved forward and remounted. In the forward seating position, the operator is situated so that he/she may operate all controls and look almost straight down with an unobscured view of the cracks and saw blades 72. Since the controls are hydraulic or hydrostatic, moving the controls 26, 30, 31 and 32 is accomplished by rerouting components and hydraulic control lines without uncoupling.

Figure 10:
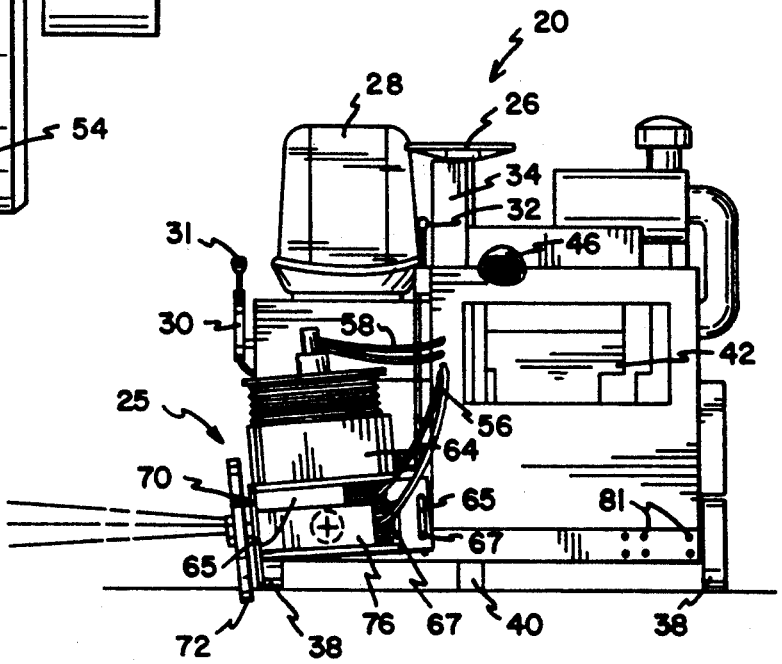

As shown in FIG. 10, the saw 20 can be configured for patching with a cutting assembly 25 mountable at a tilted position for making angled cuts as are used in pavement patching. With cuts angled in, the patch section lifts out without interference from the sides, as occurs in vertical cuts. The cuts are generally along a straight line so that the angled cutting assembly 25 is mounted so that the blades 72 extend to the right of the saw 20. The operator is seated as for other straight line sawing, so that the seat 28 and controls 26, 30, 31 and 32 and front wheels 38 are mounted as shown in FIG. 1. The blades 72, arbor 74 and motor 76 are mounted for angled cutting, along axis A′ as shown in FIG. 10. Patching is often performed with traffic in an adjacent lane so that maneuvering room may be limited. Since the slope of the cut must always be toward the inner portion of a patch, there may not be sufficient maneuvering room for the saw 20 to make cuts in both directions with the blades 72 extending to the right of the saw 20. To enable the saw 20 to make cuts in the same direction of opposite sides of a patch, the cutting assembly 25 can be attached on the mounting bracket 80 with the cutting assembly 25 mountable tilting up along axis C, or down along axis A′, so that the inward sloping cuts may be made on opposite sides of a patch with the saw 20 moving in only one direction. The cutting assembly 25 attaches to mounting bracket 80 with an indexing bracket 65 having arced attachment slots 67 providing a range of attachment positions so the assembly 25 may be tilted up, down or may be level. The assembly 25 may be easily tilted to a different angle by loosening bolts in slots 67, moving the assembly 25 to the desired position and tightening the assembly 25. It can be appreciated that the angled cutting assembly 25 is easily removed from mounting bracket 80 and is interchangeable with other cutting assemblies and may be mounted in a number of positions for other types of sawing. It can also be appreciated that the angled cutting assembly 25 may be mounted along level axis B′ so the blades 72 are vertical for standard joint sawing.

Figure 4:
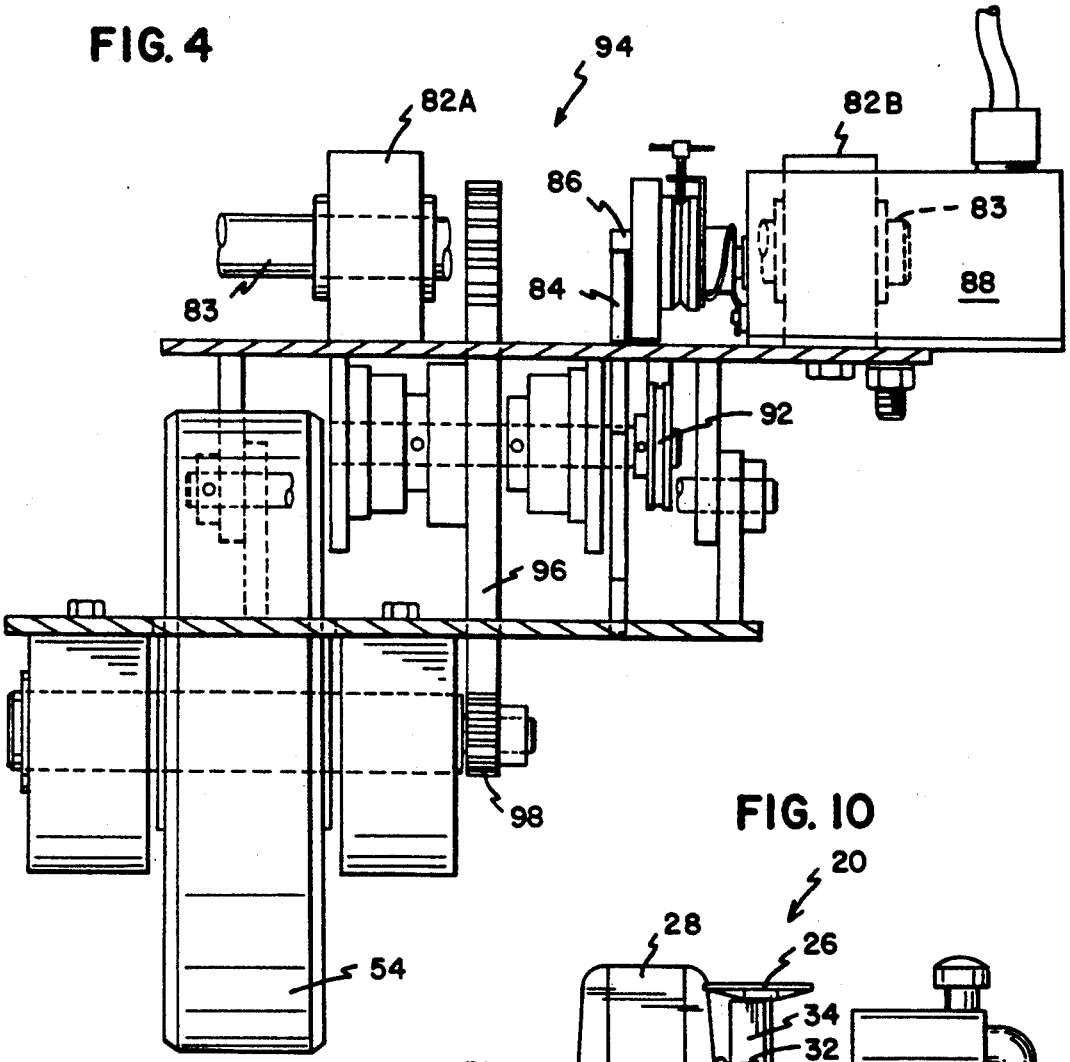
FIG. 4 shows a front elevational view of a timing assembly for sawing and spacing depressions in the pavement according to the principles of the present invention.
Figure 5:
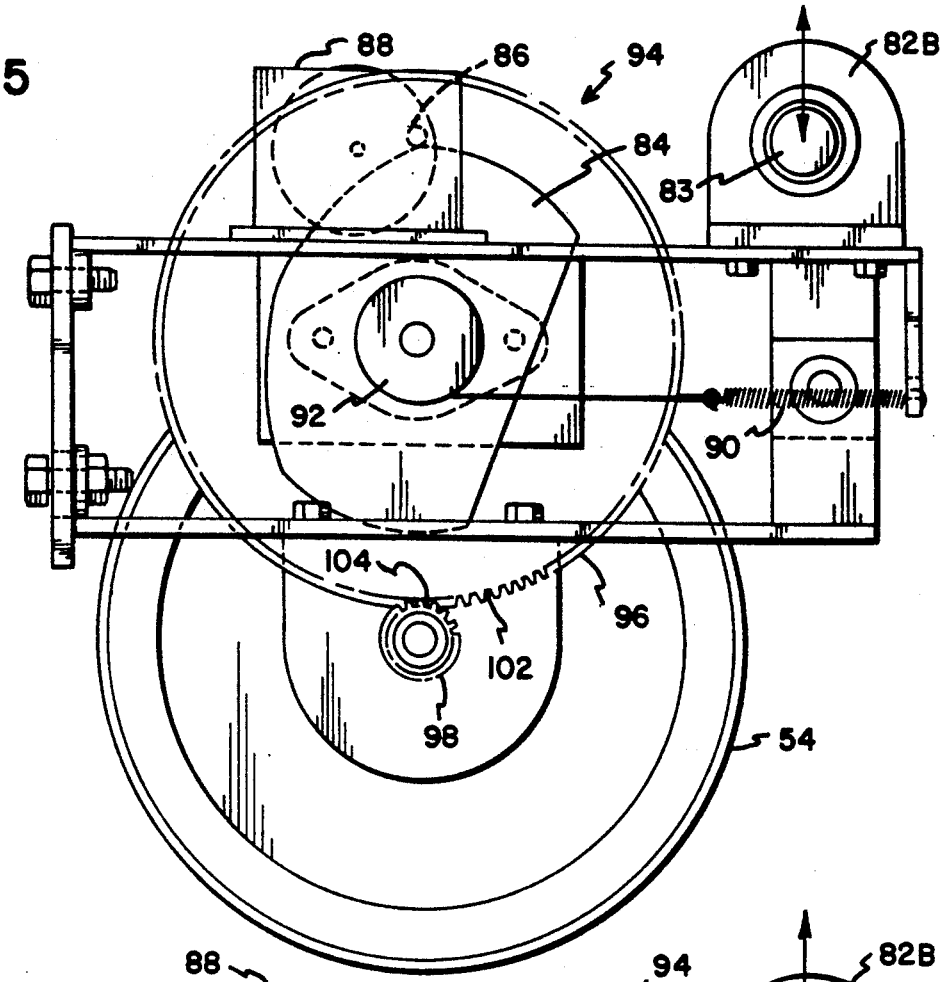
FIG. 5 shows a side elevational view of the timing assembly shown in FIG. 4 at the beginning of the cut.
Figure 6:
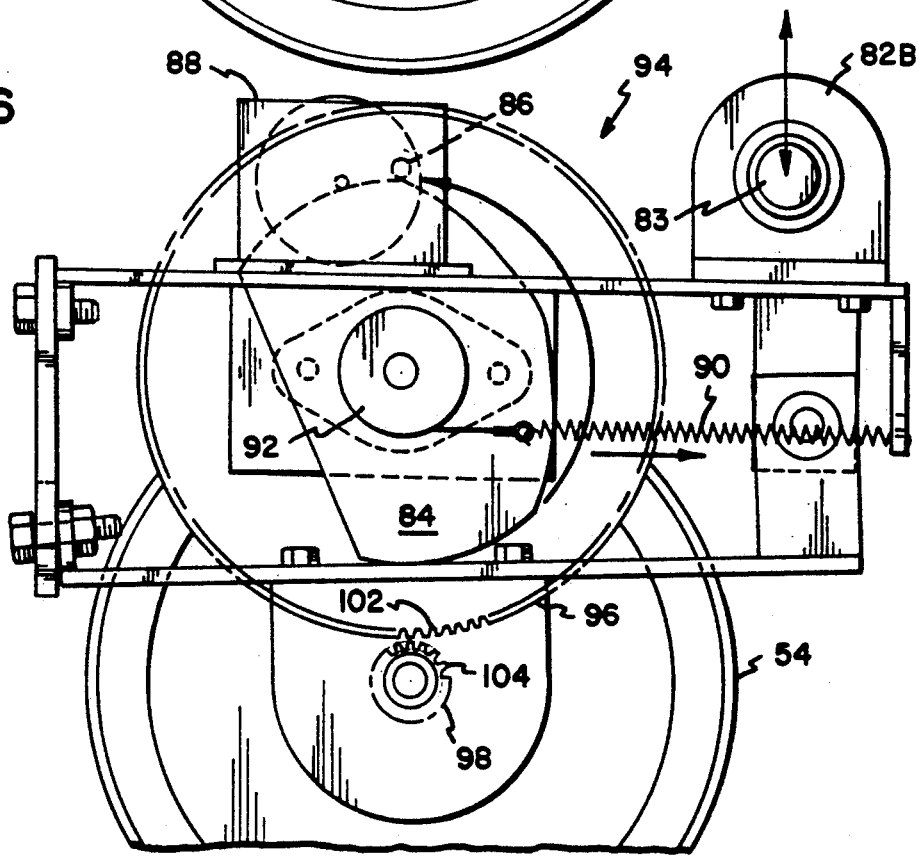
FIG. 6 shows a side elevational view of the timing assembly shown in FIG. 5 at the end of a cut at the instant wherein the drive gears have disengaged but before the cam recoils.

The riding saw 20 can be adapted for sawing specific profiles in the pavement with a timing mechanism 82, shown in FIGS. 4–6, controlling the lift mechanism 52. The timing mechanism 82 is used for sawing special jobs such as, for example, sawing hollows for recessed reflectors as shown in FIGS. 8 and 9. In FIG. 8 there is shown a recess wherein the entrance to the recess and the exit from the recess are gradually sloped. In FIG. 9 is shown a recess wherein the entrance to the recess is sloped but the exit is non-tapered, having the profile of the blade. Differing shapes of recess are selected for different pavements, terrains and climates. Each shape requires a specific repeatable profile which calls for timing and depth for controlled raising and lowering of the blades.

As shown in FIG. 4, the timing mechanism 82 utilizes a cam 84 with a cam follower 86 to raise and lower the blade assembly 70 shown in FIG. 1 for following the profile of the recess. As the follower 86 rises and falls, shaft 83 supported on bearings 82*a* and 82*b* pivots up and down. The shaft 83 pivots about an end at bearing 82*b* so that blade assembly 70, shown in FIG. 1, at the opposite end of the shaft 83 also is pivoted up and down with the cam follower 86. The radius of the cam 84 increases and decreases so that the follower 86 rises and falls as the cam 84 rotates. The blades 72 rise and fall with the follower 86 so that as the saw 20 moves forward, the blades 72 rise and fall to cut the desired profile of the recess.

The cam 84 is rotated by a cam drive mechanism 94. The cam drive mechanism 94 includes the large 10 inch diameter contact wheel 54 which touches the ground upon lowering the blade assembly 70. Upon touching the ground, contact wheel 54 moves a first gear 96, concentric with the cam 84, into contact with a second gear 98 as shown in FIG. 5. Teeth 102 and 104 of the gears 96 and 98 mesh together and begin to rotate. A command sensor 88 linked to the cam follower 86 sends a signal to a screw feed 108 which raises and lowers the blade assembly 70. In addition, a feedback sensor 89 attaches to lift mechanism 52, as shown in FIG. 1, and detects vertical position of the blade assembly 70. As the cam 84 rotates, the follower 86 rises and falls and the sensor 88 commands raising and lowering of the screw feed 108 and the blade assembly 70. When the cam 84 completes its cycle, it actuates raising the blade assembly 70. The cam drive mechanism 94 also rises so that the gears 96 and 98 disengage upon completing the cycle. A spring 90 attached to cam extension 92, rotating with the cam 84, is extended as the cam rotates through its cycle as shown in FIG. 6. The spring 90 releases as the gears 96 and 98 disengage and will then spring back, rotating the cam 84 to the cycle start position shown in FIG. 5.

The command information from the height sensor 88 and the feedback information from the height sensor 89 is relayed to the electronic control or microprocessor 34 which receives the various data for use in sending information back to the cutting assembly to direct making desired cuts. It can be appreciated that with a different cam and/or by reprogramming the microprocessor, the saw 20 can easily be adapted for sawing different recesses and performing other specialty cuts. In addition, the saw blades 72 can be replaced and the cutting assembly 24 may be moved to a different position on the saw 20, as explained hereinbefore, providing flexibility for sawing a variety of cuts and specialty cuts heretofore restricted to sawing by non-riding saws.

For cutting recesses such as those shown in FIGS. 8 and 9, in the preferred embodiment, the points A–D on the cam 84 shown in FIG. 7 correspond to the position of the blades at points A–D of the recess 110 shown in FIG. 8 moving right to left, while points A–C on the cam 84 correspond to the position of the blades at points A–C of the recess 112 shown in FIG. 9. As the saw 20 moves forward, contact wheel 54 rotates the cam 84 via the gears 96 and 98. The cam follower 86 rises and falls with the changing radius of the cam so that the blades 72 rise and fall in a like manner. Referring now to FIGS. 7 and 8, there is shown the recess 110 having a tapered entrance 114 and exit 118 and the corresponding cam 84 for making the necessary tapering cuts. At the beginning of cutting the recess 110, the blades 72 are at ground level at point A. The cam 84 is positioned so that the follower 86 rests at point A on the cam while the blades 72 are at point A at the beginning of the recess 110. As the cam 84 rotates, the cam follower 86 rides along the cam as the cam radius decreases so that the follower falls. The blades 72 lower with the follower 86, making a deepening cut.

As the cam 84 rotates so that the follower 86 rides to point B on the cam 84, the blades 72 cut the entrance taper 114 to point B in the recess 110. The follower 86 then follows the constant radius portion of the cam 84 between points B and C. The saw 20 continues to move forward with the blades 72 lowered for cutting the bottom 116 of the recess 110 between points B and C in FIG. 8. This cuts the deepest bottom portion 116 of the recess 110 between points B and C of the recess, typically at a depth of $\frac{5}{8}$ to $\frac{3}{4}$ of an inch.

As the cam 84 rotates so that the cam follower 86 rests at point C on the cam, the radius of the cam begins to increase so that the follower 86 begins to rise. As the follower 86 rises, the blade assembly 70 and the blades 72 begin to rise. As the saw 20 continues to move forward toward the end of the recess 110, the blades 72 gradually rise until reaching the ground level at point D, thereby completing the cut. This corresponds to the cam follower 86 reaching point D on the cam 84. When the cut is completed, the blade assembly 70 is raised off the ground to a transport height for travelling to the next recess.

Since the entrance 114 and exit 118 in recess 110, are twice the length of bottom portion 116, the portions from A to B and C to D on the cam 84 are twice as long as the portion from B–C. This corresponds to the relative lengths of the portions of the recess 110. In the preferred embodiment, the cam 84 rotates 90° while the blades 72 cut the recess 110. Therefore, the arc A–B subtends an angle of 36°, arc B–C subtends an angle of 18° and arc C–B subtends an angle of 36° in the preferred embodiment.

Similarly, the cam 84 can be used for cutting a recess 112 having a non-tapered exit 120, as shown in FIG. 9. The method of cutting the recess 112 corresponds to the method described above for recesses 110 having a tapered exit until the follower reaches point C on the cam 84 and the blades cut to point C in the recess 112. At that point of the cutting, the tapered entrance 114 and the flat bottom 116 have been cut. However, instead of gradually raising, the blade assembly 70 lifts straight up to above ground level so that the exit 120 is curved following the circumference of the saw blades 72, as shown in FIG. 9, rather than being gradually tapered, as shown in FIG. 8.

When a recess has been fully cut, the cam 84 moves back so that the follower rests on point A, as shown in FIG. 5 and is ready for the beginning of another cut. The cam 84 rotates only through one quarter turn repeatedly between points A and D and then rotates back through the quarter turn rather than rotating completely so that each recess has an identical profile.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A riding pavement saw apparatus having movable controls and movable and interchangeable sawing components, comprising:

a) first sawing means for sawing along straight lines;

b) second sawing means for sawing along random cracks or curves, wherein the first and second sawing means are interchangeable; and, c) adjustable saw support wheels, wherein the support wheels mount at a first position behind the first sawing means for straight line sawing, and wherein the support wheels mount at a second position with the second sawing means intermediate the saw support wheels for random crack or curve sawing.

2. A pavement saw according to claim 1, further comprising third sawing means for sawing angled cuts in pavement, wherein the third sawing means is interchangeable with the first and second sawing means.

3. A pavement saw apparatus according to claim 1 wherein the first sawing mean sis tiltable for making angled cuts.

4. A pavement saw apparatus according to claim 1 wherein the controls are hydraulically actuated and wherein the sawing means are hydraulically actuated.

5. A pavement saw apparatus according to claim 4, wherein the controls comprise: hydrostatic saw speed control means for controlling the sped of the saw; hydraulically actuated steering means for controlling the steering of saw; hydrostatic saw blade speed and direction control means for controlling the speed and rotational direction of the saw blades; and, hydraulically actuated blade height control means.

6. A pavement saw apparatus according to claim 2, wherein the third sawing means is adjustably mounted for varying the cutting angle.

7. A pavement saw apparatus according to claim 5, wherein the steering system comprises a movable steering wheel sot hat the operator may be positioned at a first position for viewing the blade for following cracks or curves and wherein the operator may be positioned at a second position for straight line sawing.

8. A pavement saw apparatus according to claim 5, wherein the operator's seat is movable from a first position for random crack and curve sawing to a second position for straight line sawing.

9. A pavement saw apparatus according to claim 1, wherein the sawing means include saw blades movable form a first position wherein the saw blades are in front of the machine and extend to one side, to a second position wherein the blades are centered on the turning axis of a steerable wheel for following cracks and curves.

10. A pavement saw apparatus according to claim 1, further comprising an attachment panel having a plurality of attachment positions for attaching the blade assemblies at a plurality of positions.

11. A pavement saw apparatus according to claim 10, further comprising movable wheels mounting at the sides of the saw or mounting along the attachment panel.

12. An apparatus according to claim 1, further comprising timing means for controlling the blade control means in a predetermined pattern to space and cut recesses in the pavement.

13. A riding pavement saw apparatus, comprising:

(a) a riding saw body supported on wheels including a rear steerable wheel;

(b) a front transverse mounting panel extending proximate the riding saw body;

(c) movable front wheels mounting at a first position for straight line sawing, and mounting on attachments to the mounting panel for random crack sawing;

(d) a movable operator seat mounting on top of the riding saw body, wherein the set is positioned at a first operating position for straight line sawing and wherein the seat is movable to a second operating position for random crack sawing, so that the operator may view the sawing from above;

(e) movable controls for controlling the saw, movable to accessible locations form the first and second operation positions;

(f) first saw blade means mounting at a first position on the mounting panel for sawing in straight lines; and, (g) second saw blade means mounting at a second position on the mounting panel for sawing random cracks.

14. A riding saw according to claim 13, wherein the second saw blade means includes saw blades centering on the turning axis of the steerable wheel and the front wheels.

15. A riding saw according to claim 13, wherein the first and second saw blade means include means for raising and lowering the saw blade means, and wherein the saw blade raising a lowering means are mountable at a plurality of positions on the mounting panel.

16. A riding pavement saw according to claim 15, wherein the saw blade means raise and lower on hydraulic cylinders.

17. A pavement saw according to claim 13, further comprising third sawing means for sawing angled cuts in pavement, wherein the third sawing means is interchangeable with the first and second sawing means.

18. A pavement saw apparatus according to claim 13, wherein the first sawing means is tiltable for making straight or angled cuts.

19. A riding pavement saw apparatus, comprising:

(a) a riding saw body supported on wheels including a rear steerable wheel;

(b) a transverse mounting panel extending proximate the riding saw body;

(c) movable front wheels mounting at a first position for straight line sawing, and mounting on attachments to the mounting panel at a second position for random crack sawing;

(d) first saw blade means mounting at a first position on the mounting panel for sawing in straight lines; and, (e) second saw blade means mounting at a second position on the mounting panel for sawing random cracks.

20. A pavement saw according to claim 19, further comprising third saw blade means for sawing angled cuts in pavement, wherein the third saw blade means is interchangeable with the first and second saw blade means.

* * * * *

UNITED STATES PATENT AND TRADEMARK OFFICE

CERTIFICATE OF CORRECTION

PATENT NO. : 5,215,071

DATED : June 1, 1993

INVENTOR(S) : Mertes et al.

It is certified that error appears in the above-identified patent and that said Letters Patent is hereby corrected as shown below:

On the title page:
Section [57], Abstract, Line 11, DELETE "-" after --timing--

Column 1, Line 14, DELETE "develop" and INSERT therefor --develops--

Column 4, Line 3, DELETE "and," after "reflector,"

Column 6, Line 41, DELETE "C," and INSERT therefor --C'--

Column 9, Line 32, DELETE "sped" and INSERT therefor --speed--

Column 9, Line 43, DELETE "sot hat" and INSERT therefor --so that--

Column 9, Line 53, DELETE "form" and INSERT therefor --from--

UNITED STATES PATENT AND TRADEMARK OFFICE

CERTIFICATE OF CORRECTION

PATENT NO. : 5,215,071

DATED : June 1, 1993

INVENTOR(S) : Mertes et al

It is certified that error appears in the above-indentified patent and that said Letters Patent is hereby corrected as shown below:

Column 10, Line 35, DELETE "a" and INSERT therefor --and--.

Signed and Sealed this

Twenty-sixth Day of April, 1994

*Attest:*

Bruce Lehman

BRUCE LEHMAN

*Attesting Officer*

*Commissioner of Patents and Trademarks*